US010433678B1

(12) United States Patent
Peters

(10) Patent No.: US 10,433,678 B1
(45) Date of Patent: Oct. 8, 2019

(54) BATHTUB WALL PANEL EXTENSION

(71) Applicant: William Peters, Long Beach, CA (US)

(72) Inventor: William Peters, Long Beach, CA (US)

( * ) Notice: Subject to any disclaimer, the term of this patent is extended or adjusted under 35 U.S.C. 154(b) by 0 days.

(21) Appl. No.: 15/936,614

(22) Filed: Mar. 27, 2018

(51) Int. Cl.
*A47K 3/00* (2006.01)
*E06B 7/23* (2006.01)

(52) U.S. Cl.
CPC ..... *A47K 3/001* (2013.01); *A47K 3/006* (2013.01); *A47K 3/008* (2013.01); *E06B 7/23* (2013.01)

(58) Field of Classification Search
CPC ..... A47K 3/001; A47K 3/006; A47K 3/02; A47K 3/14; A47K 3/302; A47K 3/32; A47K 3/34; A47K 3/38
USPC ..... 4/553, 557, 593, 609, 610
See application file for complete search history.

(56) References Cited

U.S. PATENT DOCUMENTS 1,013,162 A * 1/1912 Hiteshew ..... A47K 3/38 123/195 R
1,159,507 A * 11/1915 Lang ..... A47K 3/38 4/558
2,015,021 A * 9/1935 Samelow ..... A47K 3/283 4/557
3,864,762 A * 2/1975 Finch ..... A47K 3/006 4/555
5,231,707 A * 8/1993 Ashley ..... A47K 3/001 160/376
6,101,642 A * 8/2000 Auten ..... A47K 3/002 4/546
6,226,808 B1 5/2001 Walshe
7,237,276 B2 * 7/2007 Longman ..... A47K 3/006 4/555
8,341,774 B1 * 1/2013 Norris ..... A47K 3/34 4/557
8,443,470 B2 5/2013 Webb
D697,593 S 1/2014 Stilts
9,775,471 B1 * 10/2017 Weatherly ..... A47K 3/34
2005/0102746 A1 5/2005 Wright
2008/0010737 A1 * 1/2008 Lethert ..... A47K 3/001 4/538
2008/0083063 A1 * 4/2008 Libit ..... A47K 3/006 4/571.1
2010/0212083 A1 8/2010 Stafford
2015/0121615 A1 * 5/2015 Kay ..... A47K 3/14 4/607

FOREIGN PATENT DOCUMENTS

WO 2010099410 A 3/2011

* cited by examiner

*Primary Examiner* — Erin Deery
*Assistant Examiner* — Nicholas A Ros
(74) *Attorney, Agent, or Firm* — Kyle A. Fletcher, Esq.

(57) ABSTRACT

The bathtub wall panel extension comprises a panel, a panel seal, and a door. The panel installs on top of a front wall of a bathtub in place of a sliding shower door. The panel may use the side tracks of the shower door to stabilize it in an upright position. The panel extends the height of the bathtub. The door may provide access to the bathtub though a door aperture when the door is in an open position. The door may comprise a door seal to provide a watertight seal with the panel when the door is in a closed position. The bathtub wall panel extension may comprise handholds, a magazine holder, a soap holder, a cup holder, and one or more shelves.

17 Claims, 5 Drawing Sheets

BATHTUB WALL PANEL EXTENSION

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bathroom fixtures, more specifically, a bathtub wall panel extension.

SUMMARY OF INVENTION

The bathtub wall panel extension comprises a panel, a panel seal, and a door. The panel installs on top of a front wall of a bathtub in place of a sliding shower door. The panel may use the side tracks of the shower door to stabilize it in an upright position. The panel extends the height of the bathtub. The door may provide access to the bathtub though a door aperture when the door is in an open position. The door may comprise a door seal to provide a watertight seal with the panel when the door is in a closed position. The bathtub wall panel extension may comprise handholds, a magazine holder, a soap holder, a cup holder, and one or more shelves.

An object of the invention is to extend the height of a bathtub.

Another object of the invention is to provide a watertight door for entry and egress.

A further object of the invention is to use side tracks from an existing shower door to support the panel in an upright position.

Yet another object of the invention is to provide a magazine rack, soap holders, cup holder and one or more shelves on the panel.

These together with additional objects, features and advantages of the bathtub wall panel extension will be readily apparent to those of ordinary skill in the art upon reading the following detailed description of the presently preferred, but nonetheless illustrative, embodiments when taken in conjunction with the accompanying drawings.

In this respect, before explaining the current embodiments of the bathtub wall panel extension in detail, it is to be understood that the bathtub wall panel extension is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bathtub wall panel extension.

It is therefore important that the claims be regarded as including such equivalent construction insofar as they do not depart from the spirit and scope of the bathtub wall panel extension. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
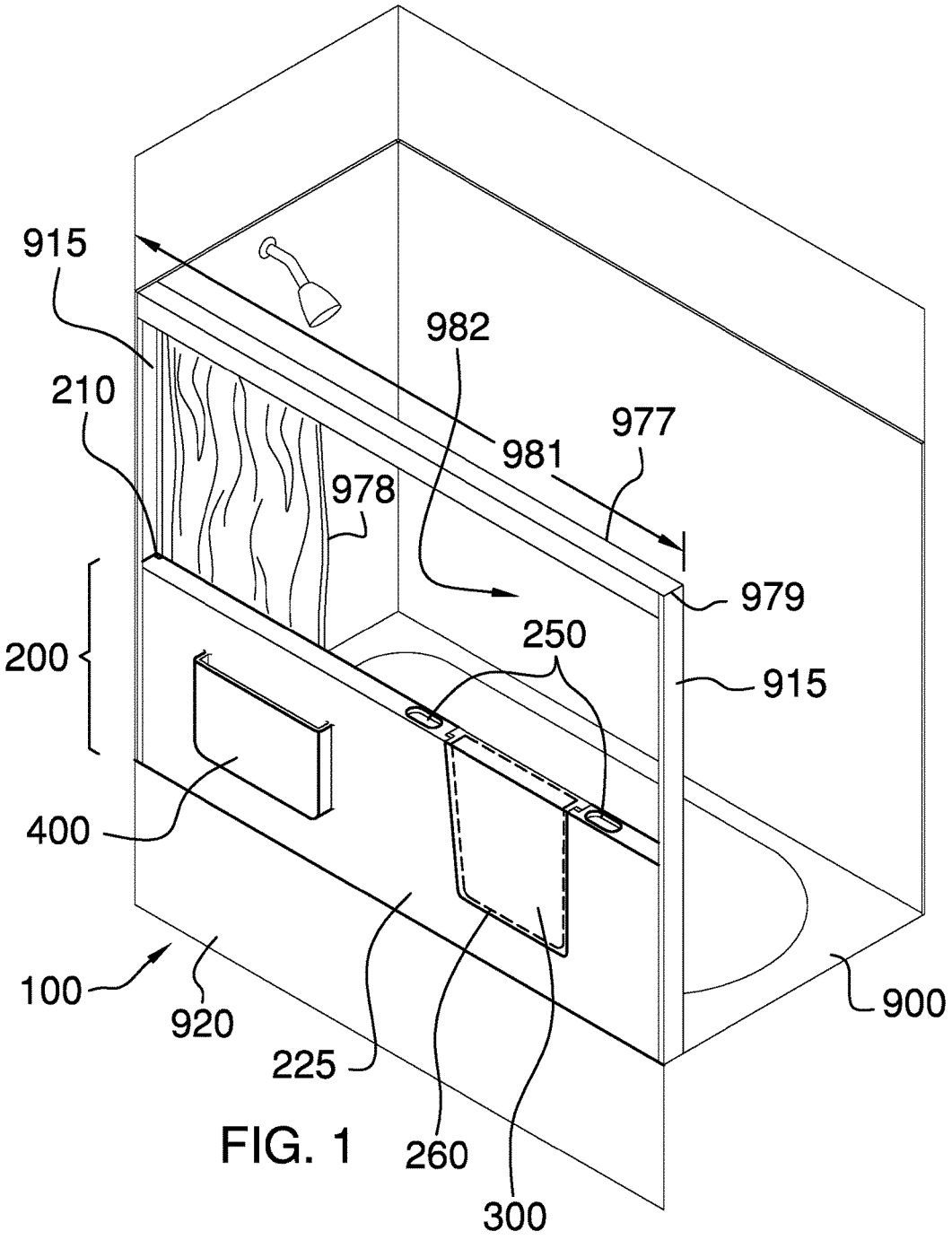
FIG. 1 is an in-use view of an embodiment of the disclosure.
Figure 2:
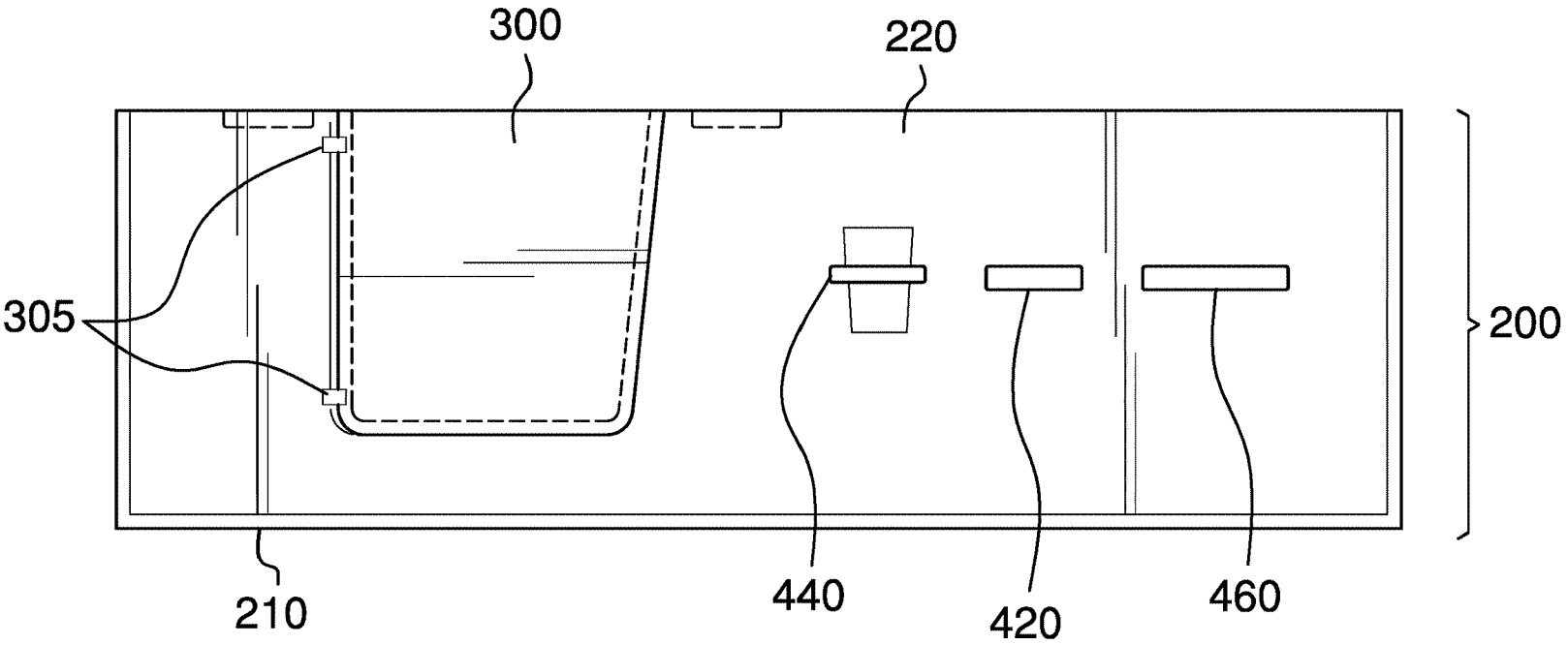
FIG. 2 is a side view of an embodiment of the disclosure from inside of the bathtub.
Figure 3:
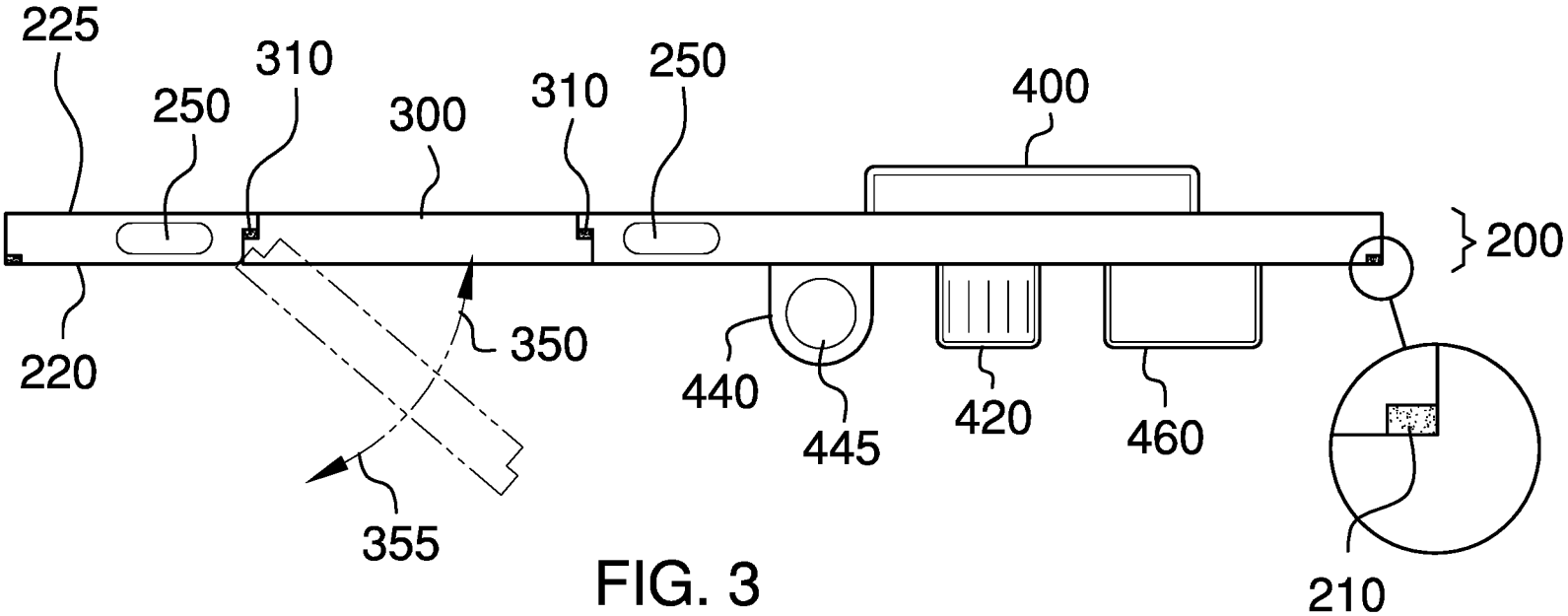
FIG. 3 is a top view of an embodiment of the disclosure.
Figure 4:
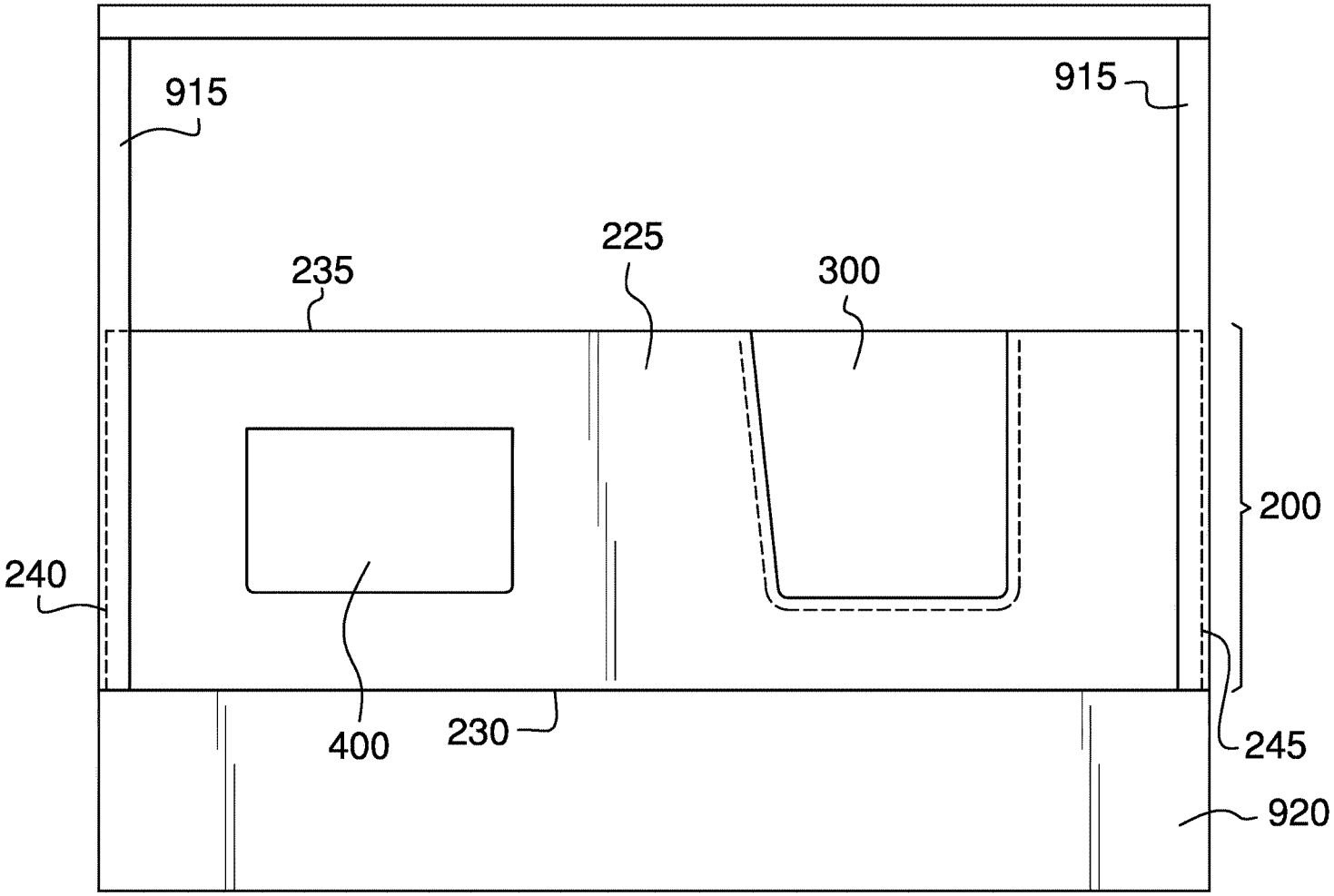
FIG. 4 is a side view of an embodiment of the disclosure from outside of the bathtub.
Figure 5:
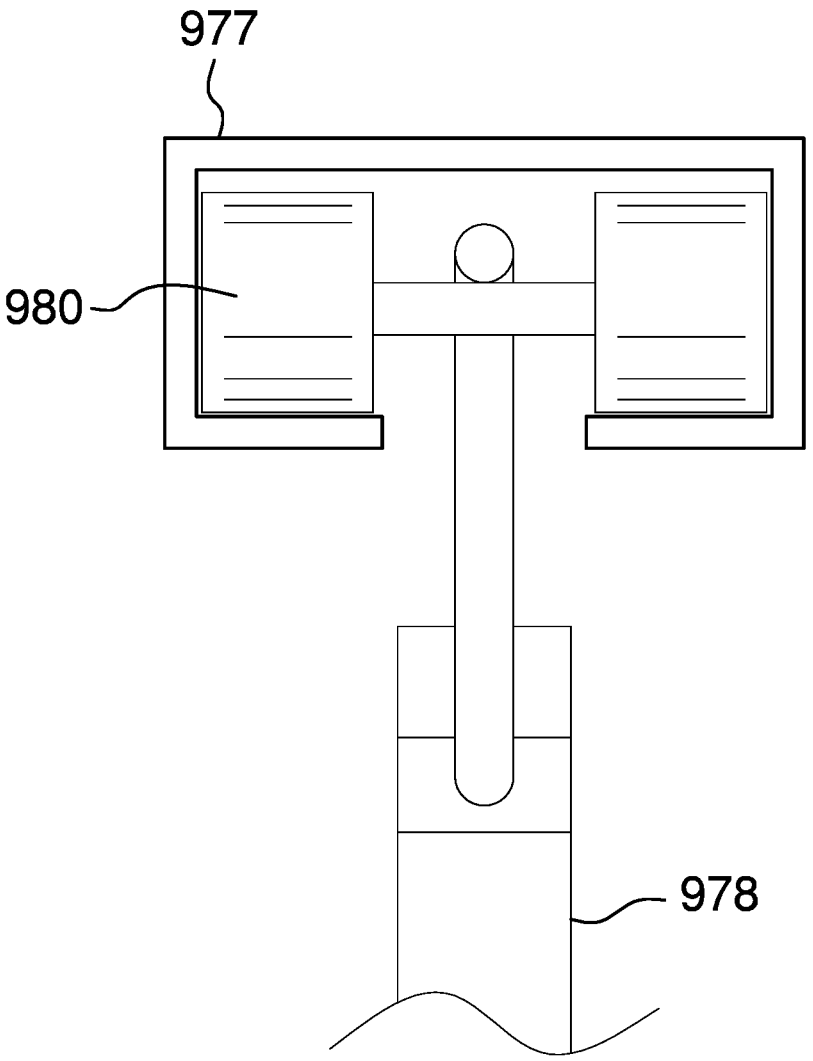
FIG. 5 is a cross-sectional view along line 5-5 in FIG. 1.

Detailed reference will now be made to a first potential embodiment of the disclosure, which is illustrated in FIGS. 1 through 5.

The bathtub wall panel extension 100 (hereinafter invention) comprises a wall panel 200, a panel seal 210, and a door 300. The invention 100 may rest on top of a front wall 920 of a bathtub 900 held in place by a pair of side tracks 915. The invention 100 may increase the depth of the bathtub 900. The door 300 may provide entry to and egress from the bathtub 900 through the wall panel 200.

The wall panel 200 may be an extension wall for the bathtub 900 that increases the height of the front wall 920 of the bathtub 900. The length of the wall panel 200 may match the length of the bathtub 900. The height of the wall panel 200 may vary—typical heights may be between 10 inches and 24 inches.

A bottom edge 230 of the wall panel 200 may rest on the top surface of the front wall 920 of the bathtub 900. The wall panel 200 may be held upright by the pair of side tracks 915. Specifically, a left side edge 240 of the wall panel 200 and a right side edge 245 of the wall panel 200 may slide into the pair of side tracks 915 and the pair of side tracks 915 may prevent the wall panel 200 from rotating.

In some embodiments, the invention 100 may replace a shower door (not illustrated in the figures) that previously coupled to the top of the front wall 920 of the bathtub 900. The pair of side tracks 915 may have previously been used with the shower door or the pair of side tracks 915 may be installed new to support the wall panel 200.

In some embodiments, the invention 100 may include a top track 977. The top track 977 spans across the pair of side tracks 915 in order to support a shower curtain 978. The top track 977 attaches to a top end 979 of each of the pair of side tracks 915. The top track 977 is constructed with a "C" channel, which enables sliding members 980 to traverse across a length 981 of the top track 977 (see FIG. 5). The shower curtain 978 is attached to the sliding members 980 in order to extend and retract across a top opening 982 formed between the pair of side tracks 915, the top track 977, and the top edge 235 of the wall panel 200.

The panel seal 210 may prevent water (not illustrated in the figures) from leaking at the edges of the wall panel 200. As non-limiting examples, the panel seal 210 may be a gasket, rubber strip, or other watertight interface. The panel seal 210 may be located along the bottom and side edges of the wall panel 200.

In some embodiments, the panel seal 210 may be augmented with an applied sealer. As a non-limiting example, the applied sealer may be silicone caulk.

The wall panel 200 may comprise a door aperture 260. The door aperture 260 may be a cut-out in the wall panel 200. The door aperture 260 may reach the top of the wall panel 200 to form a U-shaped opening in the wall panel 200.

The door aperture 260 may be wider and taller on an inside surface 220 than it is on an outside surface 225 in order to block outward movement of the door 300.

The door 300 may be a moveable panel that covers the door aperture 260. The shape of the door 300 may match the shape of the door aperture 260 on the inside surface 220. The door 300 may be smaller than the door aperture 260 on the inside surface 220 and larger than the door aperture 260 on the outside surface 225 so that the door 300 closes against the wall panel 200 on the inside surface 220 and is blocked from passing through to the outside. The door 300 may be hingedly coupled to the inside surface 220 via one or more door hinges 305. The door 300 may pivot away from the wall panel 200, into the bathtub 900, when in an open position 355. The door 300 may pivot towards the wall panel 200 and fit into the door aperture 260 when in a closed position 350.

The door 300 may comprise a door seal 310. As non-limiting examples, the door seal 310 may be a gasket, rubber strip, or other watertight interface that prevents the water from leaking at the edges of the door 300 when the door 300 is in the closed position 350. The door seal 310 may be located between the door 300 and the wall panel 200 at the door aperture 260 and may follow the edge of the door 300. In some embodiments, the door seal 310 may be coupled to the door 300 and press against the wall panel 200 when the door 300 is in the closed position 350. In some embodiments, the door seal 310 may be coupled to the wall panel 200 and press against the door 300 when the door 300 is in the closed position 350.

In some embodiments, the wall panel 200 may comprise one or more hand holds 250 located on a top edge 235 of the wall panel 200. The one or more hand holds 250 may be depressions into the wall panel 200 which are adapted to serve as touch points for a user (not illustrated in the figures).

In some embodiments, the wall panel 200 may comprise a magazine pocket 400 located on the outside surface 225 of the wall panel 200. The magazine pocket 400 may be a, open-top, three-sided carrier with a bottom. The magazine pocket 400 may be configured to hold one or more magazines.

In some embodiments, the wall panel 200 may comprise a soap holder 420 located on the inside surface 220 of the wall panel 200. The soap holder 420 may be a horizontal tray configured to hold a bar of soap.

In some embodiments, the wall panel 200 may comprise a cup holder 440 located on the inside surface 220 of the wall panel 200. The cup holder 440 may be a horizontal tray with a cup aperture 445 configured to hold a cup.

In some embodiments, the wall panel 200 may comprise one or more shelves 460 located on the inside surface 220 of the wall panel 200. The one or more shelves 460 may be horizontal trays configured to hold toiletries or other items.

In some embodiments, the one or more hand holds 250, the magazine pocket 400, the soap holder 420, the cup holder 440, the one or more shelves 460, or combinations thereof may comprise one or more drainage apertures (not illustrated in the figures) to allow the water to drain through.

In use, the wall panel 200 is installed on the bathtub 900 by first removing the shower door except for the pair of side tracks 915 and then sliding the wall panel 200 down into the pair of side tracks 915 until the wall panel 200 rests on the top of the front wall 920 of the bathtub 900. The door 300 may be opened inwards and the user may step over the front wall 920 and through the door aperture 260. The door 300 may be closed and the bathtub 900 may be filled with the water to a level that is higher than the front wall 920 of the bathtub 900. After use, the water may be drained and the door 300 opened inwards to allow the user to step out.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used herein, the words "couple", "couples", "coupled" or "coupling", refer to connecting, either directly or indirectly, and does not necessarily imply a mechanical connection.

As used in this disclosure, a "door" is a movable or removable barrier that is attached to the wall of a room or the surface of a container for the purpose of allowing or preventing access through an aperture into the room or container.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "gasket" is an elastomeric material that is placed between a first surface and a second surface for the purpose of creating a liquid or gas impermeable seal between the first surface and the second surface or preventing the first surface from damaging the second surface (or vice versa).

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the term "strip" describes a long and narrow object of uniform thickness that appears thin relative to the length of the object. "Strips" are often rectangular in shape.

As used herein, the word "watertight" refers to a barrier that is impermeable to water.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A bathtub wall panel extension comprising:

a wall panel, a panel seal, and a door;

wherein the bathtub wall panel extension rests on top of a front wall of a bathtub held in place by a pair of side tracks;

wherein the bathtub wall panel extension increases the depth of the bathtub;

wherein the door provides entry to and egress from the bathtub through the wall panel;

wherein the wall panel is an extension wall for the bathtub that increases the height of the front wall of the bathtub;

wherein the length of the wall panel matches the length of the bathtub;

wherein a bottom edge of the wall panel rests on the top surface of the front wall of the bathtub;

wherein the wall panel is held upright by the pair of side tracks;

wherein a left side edge of the wall panel and a right side edge of the wall panel slides into the pair of side tracks and the pair of side tracks prevents the wall panel from rotating.

2. The bathtub wall panel extension according to claim 1 wherein the panel seal prevents water from leaking at the edges of the wall panel;

wherein the panel seal is a watertight interface;

wherein the panel seal is located along the bottom and side edges of the wall panel.

3. The bathtub wall panel extension according to claim 2 wherein the wall panel comprises a door aperture;

wherein the door aperture is a cut-out in the wall panel.

4. The bathtub wall panel extension according to claim 3 wherein the door aperture reaches the top of the wall panel to form a U-shaped opening in the wall panel.

5. The bathtub wall panel extension according to claim 4 wherein the door aperture is wider and taller on an inside surface than it is on an outside surface in order to block outward movement of the door.

6. The bathtub wall panel extension according to claim 5 wherein the door is a moveable panel that covers the door aperture;

wherein the shape of the door matches the shape of the door aperture on the inside surface.

7. The bathtub wall panel extension according to claim 6 wherein the door is smaller than the door aperture on the inside surface and larger than the door aperture on the outside surface so that the door closes against the wall panel on the inside surface and is blocked from passing through to the outside.

8. The bathtub wall panel extension according to claim 7 wherein the door is hingedly coupled to the inside surface via one or more door hinges;

wherein the door pivots away from the wall panel, into the bathtub, when in an open position;

wherein the door pivots towards the wall panel and fit into the door aperture when in a closed position.

9. The bathtub wall panel extension according to claim 8 wherein the door comprises a door seal.

10. The bathtub wall panel extension according to claim 9 wherein the door seal is a watertight interface that prevents the water from leaking at the edges of the door when the door is in the closed position;

wherein the door seal is located between the door and the wall panel at the door aperture and follows the edge of the door.

11. The bathtub wall panel extension according to claim 10 wherein the wall panel comprises one or more hand holds located on a top edge of the wall panel;

wherein the one or more hand holds are depressions into the wall panel which are adapted to serve as touch points for a user.

12. The bathtub wall panel extension according to claim 11 wherein the wall panel comprises a magazine pocket located on the outside surface of the wall panel;

wherein the magazine pocket is a, open-top, three-sided carrier with a bottom;

wherein the magazine pocket is configured to hold one or more magazines.

13. The bathtub wall panel extension according to claim 12 wherein the wall panel comprises a soap holder located on the inside surface of the wall panel;

wherein the soap holder is a horizontal tray configured to hold a bar of soap.

14. The bathtub wall panel extension according to claim 13 wherein the wall panel comprises a cup holder located on the inside surface of the wall panel;

wherein the cup holder is a horizontal tray with a cup aperture configured to hold a cup.

15. The bathtub wall panel extension according to claim 14 wherein the wall panel comprises one or more shelves located on the inside surface of the wall panel;

wherein the one or more shelves is horizontal trays configured to hold toiletries or other items;

wherein the one or more hand holds, the magazine pocket, the soap holder, the cup holder, the one or more shelves, or combinations thereof comprise one or more drainage apertures to allow the water to drain through.

16. The bathtub wall panel extension according to claim 15 wherein a top track is included and spans across the pair of side tracks in order to support a shower curtain;

wherein the top track attaches to a top end of each of the pair of side tracks.

17. The bathtub wall panel extension according to claim 16 wherein the top track is constructed with a "C" channel, which enables sliding members to traverse across a length of the top track;

wherein the shower curtain is attached to the sliding members in order to extend and retract across a top opening formed between the pair of side tracks, the top track, and the top edge of the wall panel.

* * * * *